US005149252A

United States Patent [19]

Tuckey et al.

[11] Patent Number: 5,149,252

[45] Date of Patent: Sep. 22, 1992

[54] TWO-STAGE PUMP FOR HANDLING HOT FUEL

[75] Inventors: Charles H. Tuckey; J. D. Tuckey, both of Cass City, Mich.

[73] Assignee: Walbro Corporation, Cass City, Mich.

[21] Appl. No.: 650,164

[22] Filed: Feb. 4, 1991

[51] Int. Cl.[5] ..... F04B 23/08

[52] U.S. Cl. ..... 417/205; 417/423.1; 417/423.9; 415/55.6; 415/55.7

[58] Field of Search ..... 415/55.1-55.7; 417/423.1, 423.9, 205

[56] References Cited

U.S. PATENT DOCUMENTS 4,205,947 6/1980 Ruhl et al. ..... 417/205
4,336,002 6/1982 Rose et al. ..... 417/205
4,629,399 12/1986 Friebe ..... 417/205
5,039,284 8/1991 Talaski ..... 415/55.1

*Primary Examiner*—Richard A. Bertsch
*Assistant Examiner*—Charles G. Freay
*Attorney, Agent, or Firm*—Barnes, Kisselle, Raisch, Choate, Whittemore & Hulbert

[57] ABSTRACT

A two-stage fuel pump for furnishing fuel to an internal combustion engine utilizes a side or lateral channel pump as a first stage pump to furnish liquid fuel to a second stage pump. A common armature drive shaft drives both pumps and central passages in the vicinity of the drive shaft receive vapor developed in the first stage pump and cause the vapor to exit the pump assembly. A conical baffle directs vapor free fuel to a periphery where it enters the inlet side of the second or main stage pump. A rotor in the first stage pump has central axial passages to facilitate the egress of vapor from the pump assembly.

11 Claims, 3 Drawing Sheets

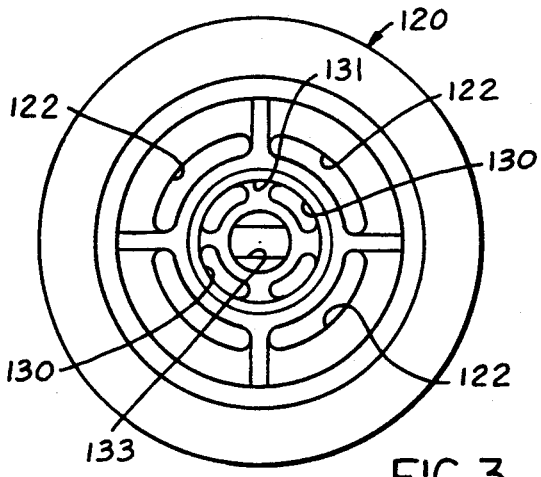
FIG.3
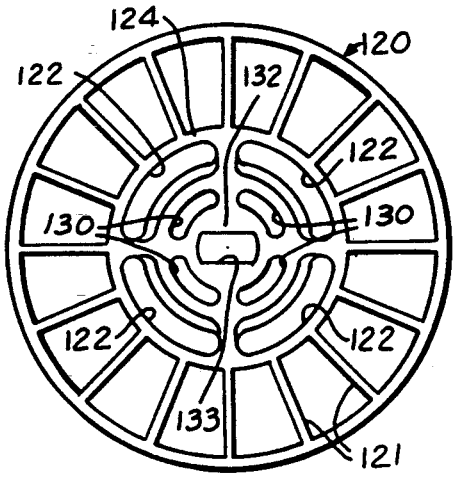
FIG.4
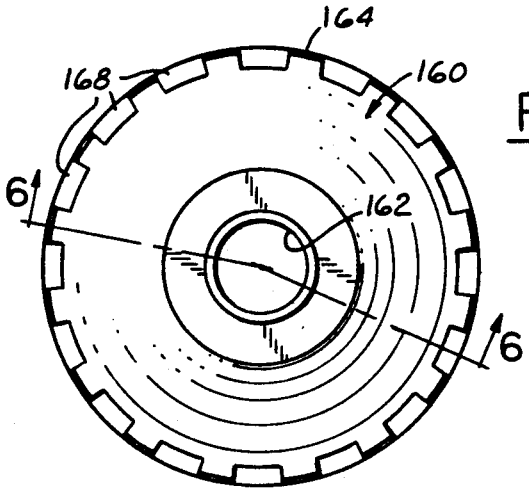
FIG.5
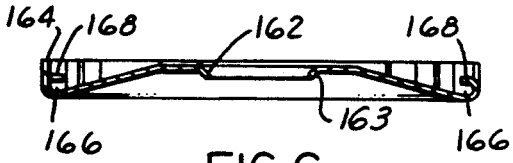
FIG.6
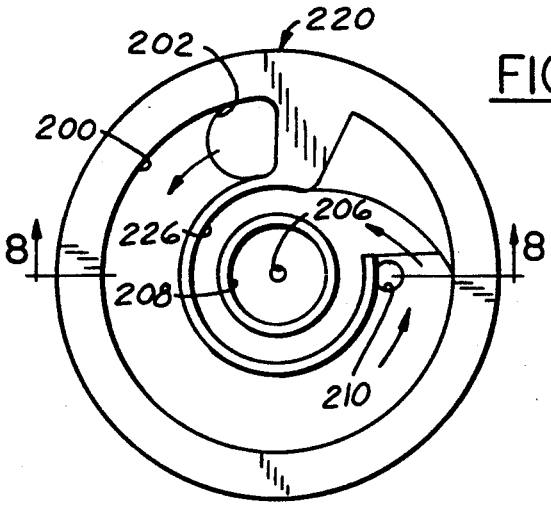
FIG.7
FIG.8
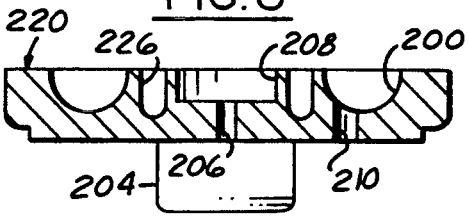

TWO-STAGE PUMP FOR HANDLING HOT FUEL

FIELD OF THE INVENTION

Fuel pumps for internal combustion engines using a lateral first stage pump to supply a main high pressure positive displacement pump.

BACKGROUND AND FEATURES OF THE INVENTION

Fuel pumps, electrically driven, are used for furnishing liquid fuel to internal combustion engines. In recent years, these fuel pumps have been mounted inside the fuel tanks of vehicles sometimes within a vertical canister which receives fuel returning from a circuit including a pressure relief and return valve. In geographic regions, where high temperatures are experienced, at least in some seasons of the year, pumping hot fuel creates problems because the fuel tends to vaporize. This is especially true with the lighter fuel which may contain alcohol or other light additives. When a fuel pump draws an inducing pressure on liquid fuel, especially hot fuel, there is a tendency for the fuel to vaporize. Vapor in a pump significantly reduces the efficiency. When a vehicle sits out in the hot sun, the temperature in a fuel tank will rise close to the vaporization point.

To alleviate this problem, and for other reasons of efficiency, one recent development has been to incorporate two pumps in series, that is, a first stage pump to draw fuel from the tank and furnish the fuel to a second stage pump which delivers the fuel to the engine.

The present invention is directed to the use of a two-stage pump and embodies an assembly using a side channel, sometimes called a lateral channel, first stage pump which draws fuel from a fuel tank and furnishes it to a main second stage pump which is preferably a positive displacement pump of the roller vane type, or a gear rotor pump where two gears, one within the other, rotate to force fuel into a vehicle system under a desired pressure. The term gerotor is applied to the gear rotor pump.

The present invention is also directed to the use of a side channel pump which is designed to remove as much vapor as possible from the fuel before it is delivered to the second stage pump as solid fuel, that is, totally liquid. In this way, the delivery of the second stage pump can be dependable and will meet the pressure and volume requirements of a particular engine.

The vapor removal is accomplished by a pump assembly in which fuel delivery from the side channel pump is central of the rotor and the liquid fuel is moved outward, as the heavier medium, by the centrifugal force, and the vapor, as the lighter medium, is moved inward by the liquid fuel. Directing components move the vapor centrally where recesses and passages are provided for the escape of the vapor from the pumping system. Meanwhile, the liquid fuel from the first stage pump is moved outwardly and introduced peripherally through a conical baffle to the inlet side of the gerotor pump. Several modifications are described for achieving the removal of vapor from the first stage pump so that the fuel delivered to the main pump free of vapor.

Other objects and features of the invention will be apparent in the following detailed description and claims in which there is set forth the invention together with details to enable a person to practice the invention, all in connection with the best mode presently contemplated for the invention.

BRIEF DESCRIPTION OF THE DRAWINGS

DRAWINGS accompany the disclosure and the various views thereof may be briefly described as:

FIG. 3, a view of one side of a rotor in the first stage pump.

FIG. 4, a view of the other side of the rotor of the first stage pump.

FIG. 5, an elevation of a baffle plate.

FIG. 6, a section of the baffle plate on line 6—6 of FIG. 5.

FIG. 7, an elevation of a pump inlet housing showing a modification of the FIG. 1 embodiment as to vapor egress.

FIG. 8, a section on line 8—8 of FIG. 7.

DETAILED DESCRIPTION OF THE INVENTION AND THE MANNER AND PROCESS OF USING IT

Figure 1:
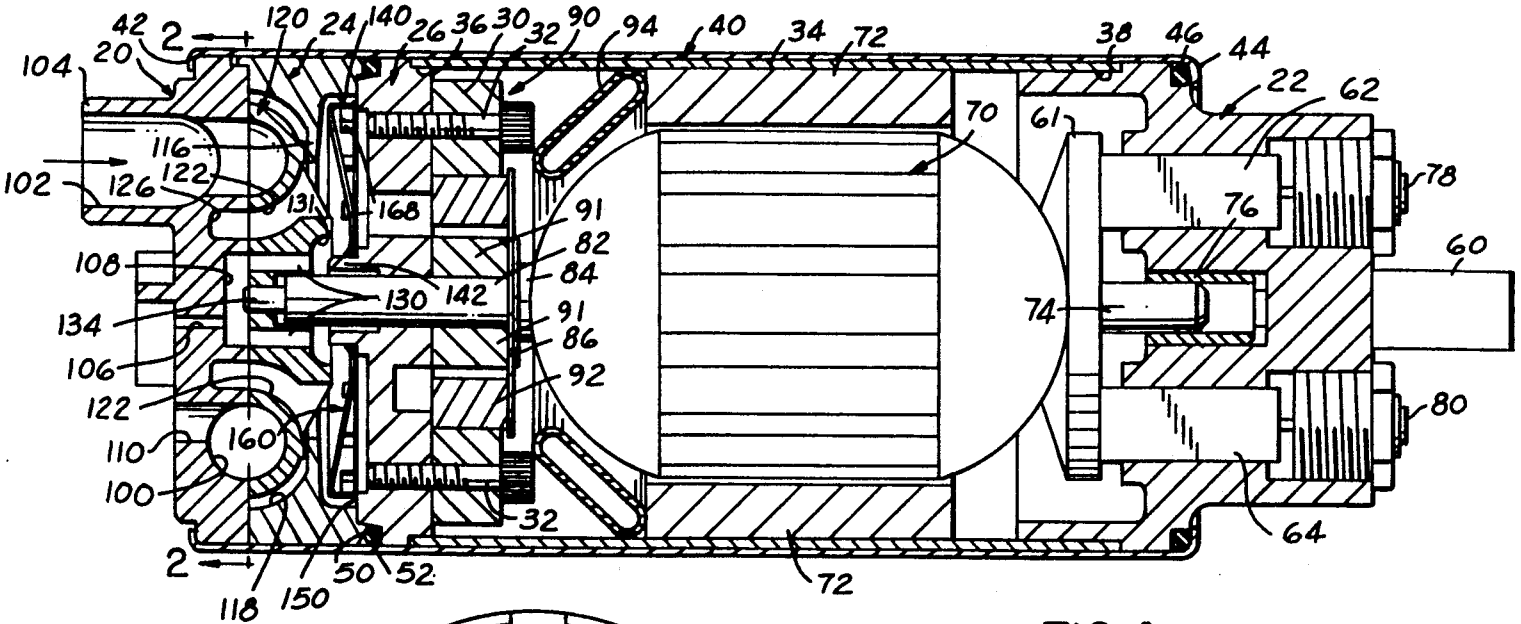
FIG. 1, a longitudinal section of a two-stage fuel pump.

In FIG. 1, section of a fuel pump is shown with an inlet housing 20 at one end and an outlet housing 22 at the other end. These pumps are usually mounted vertically in a vehicle fuel tank with the inlet end 20 at the bottom. Directly adjacent the inlet end is a spacer ring 24 positioned adjacent main pump inlet plate 26. A main pump housing 30 is bolted to the inlet plate 26 by cap screws 32.

A cylindrical flux ring 34 is seated on one end in an annular recess 36 in inlet plate 26 and at the other end in an annular recess 38 in the outlet housing 22. The entire assembly is encapsulated by a shell 40 which has inturned ends 42 and 44 at the inlet housing 20 and the outlet housing 22. A sealing O-ring 46 underlies the inturned end 44. Between a tapered projecting annular edge 50 and an annular groove 52 with a tapered outer diameter in the inlet plate 26 is a sealing O-ring 54. The double taper on the edge 50 and the groove 52 will move the O-ring out against the shell 40. This arrangement eliminates the necessity for a groove in a casting and the seal prevents any outlet pressure from escaping back to the pump area.

The outlet end 22 has a conventional outlet nipple 60 and brushes 62 and 64 which contact the commutator 66 of an armature 70 operating within permanent magnets 72. The armature has a bearing shaft 74 operating in a bushing 76 in a central recess of the outlet housing 22. The brushes have connectors 78 and 80.

At the other end of the armature is a mounting shaft 82 which passes through an eyelet 84 and a rotary seal 86 facing the rotors of a main pump 90 which can be a gerotor pump acting within the main pump housing 30. A gerotor or gear rotor pump is disclosed in U.S. Pat. No. 4,500,270 issued Feb. 19, 1985 having an assignee common to the present application. The inner rotor 91 of the pump 90, within the outer rotor 92, is preferably press fitted on to the shaft 82 and the shaft is journaled in the main pump inlet plate 26. Between the magnets 72 and the main pump 90 is a hollow flexible toroid 94 serving as a pulse dampener.

Figure 2:
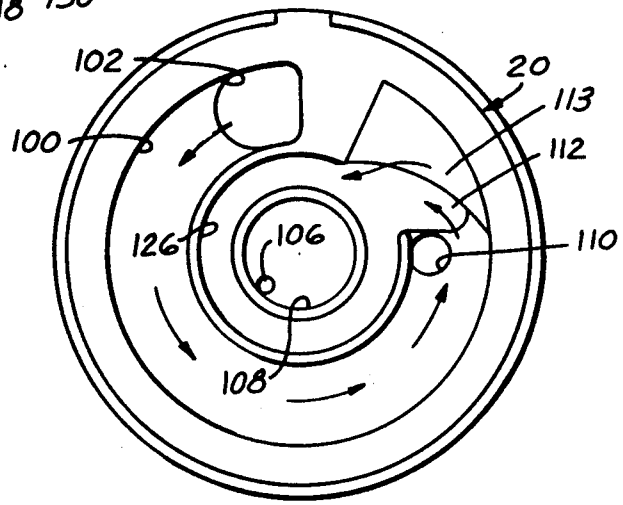
FIG. 2, a sectional view on line 2—2 of FIG. 1.
Figure 12:
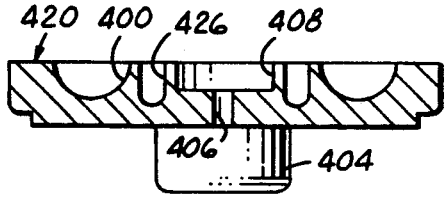
FIG. 12, a section on line 12—12 of FIG. 11.

Reverting now to the pump inlet housing 20, the housing forms one side of a lateral channel pump which can be termed a primary stage pump which feed fuel to the main pump 90. A lateral or side channel pump is disclosed in U.S. Pat. No. 4,715,777 issued Dec. 17, 1987 to an assignee common to the present application. The housing 20 has an annular channel 100 connected to an inlet passage 102 in a boss 104. This boss is illustrated as 204 (FIG. 8), 304 (FIG. 10) and 404 (FIG. 12). A vapor outlet passage 106 is provided just off-center of a central recess 108, as seen in FIG. 2. A secondary vapor outlet 110 is positioned near the outlet 112 as viewed in FIG. 2 which leads to the annular passage 126.

Next the spacer 24, directly adjacent the inlet housing 20, has a narrowing central flange 116 which projects into the cavity above the inlet housing. Within the curved wall cavity 118 formed by the flange 116 is a lateral pump rotor 120 having a semi-circular annular toroid shape with radial interior vanes 121 illustrated in FIG. 4. This rotor, viewed from the vane side in FIG. 4, has four central quarter segments, each with arcuate ports 122 near an inner rim 124. These ports open into the space inside the flange 116. These ports 122 also register radially with an annular outlet recess 126 in the inner face of inlet housing 20. Additional arcuate ports 130 open at one end to a shallow recess 131 around shaft 82 and at the other end to the vane side of the rotor to the recess 108 in the inlet housing. The central axle portion 132 (FIG. 4) of the rotor has an opening 133 for a driving connection with a flat end 134 on the armature drive shaft 82. Thus, the material in the rotor 120 between the central axle portion 132 and the vane chambers serves as spokes for the drive of the rotor.

On one side of the flange 116 is a recess 140 just adjacent the pump inlet plate 26 which has a central boss 142. A filter screen 150 is mounted centrally on this boss and at its outer perimeter lies flat against plate 26 which has a recessed wall behind the filter screen. The screen has preferably a 70×70 mesh formed of 0.0065" diameter, stainless, annealed wire. The screen is pressed against the housing 26 by a wide angle conical baffle 160 illustrated in FIGS. 5 and 6. A central hole 162 with an inturned flange 163 mounts the baffle also on the boss 142 with a press fit which locks the flange on the boss 142 by a sharp edge which digs into the boss. An axial outer flange 164 is curved in at regularly circumferentially spaced intervals as at 166 to form circumferentially spaced windows 168. The recesses under the curved-in portions 166 can serve as dirt traps.

When the fuel pump is operating and the armature rotating, the mounting shaft will be driving the inner rotor 91 of the main gerotor pump which is pressed on to the shaft 82. The rotor 120 of the primary or first stage pump is also rotated at the same speed by the shaft 82.

An object of the present multiple pump assembly above described is to remove as much vapor as possible from the system in conditions where the ambient temperature and the fuel temperature is high. The purpose, therefore, of the first stage or primary channel pump is to provide liquid fuel without vapor to the main stage pump. As a general rule, the first stage pump is intended to have a 60% more capacity than the main pump but the excess capacity is entirely removed as vapor or in a relief phase.

A first feature of the channel pump assembly lies in the development of primary pressure outlet fluid in the passage 100 (FIG. 2), the outlet 112,126 and the ports 122 leading to the flow path in front of and to the periphery of the conical baffle plate 160 where it enters the windows 168 (FIGS. 1 and 6) and reaches the inlet side of the gerotor pump 90. This primary pressure also reaches the curved wall cavity 118 under the spacer flange 116. This pressure develops under this baffle ring to hold the rotor 120 against the inlet housing 20. If the first stage rotor is lifted, outer pressure develops under the baffle flange 116 to hold the rotor down. The flange can, with suitable dimensioning, provide a mechanical limit to the lifting of the rotor but also, in full operation, pressure on the outside of the channel rotor 120 and on the inside should be essentially equal so there is no physical contact with the spacer flange 116 and consequently no wear.

Another feature incorporated in the assembly of the lateral channel pump lies in the radially outward curvature of the ports 122 which enhances the radially outward flow of the outlet fuel toward the periphery of the windowed baffle 160. The solid fuel (i.e. liquid) moves outward and any vapor or air will be forced radially inward where it will enter the shallow recess 131 and pass through the axial passages 130 to the recess 108. The conically shaped baffle plate 160 also functions to move liquid fuel outwardly while forcing the lighter vapor components toward central recess 131. The vapor can escape outside the pump through the axial passage 106. Thus, there can be a constant elimination of vapor while the primary pump is delivering liquid fuel to the main gerotor pump. This function of elimination of vapor is significant in geographical areas where the ambient temperature reaches ranges from, for example, 80° F. to 120° F.

In FIGS. 1 and 2, an auxiliary vapor outlet 110 is shown at the inner radius of channel 100 directed adjacent the outlet diverter 112. Here again liquid fuel will force the vapor to the inside of the channel where it will reach the vapor outlet 110. The filter screen is located between the primary pump and main high pressure pump to filter out particles in the fuel. In FIG. 2, a ramp 113 radially outward of passage 110 forces air and vapor to the inside as the solid fuel goes to the outside.

FIGS. 7 and 8 illustrate a modification of the inlet housing 20 with respect to vapor outlet ports. In this embodiment the housing 220 has a side channel 200, an outlet passage 226, and a central shallow recess 208 inside the outlet passage for accumulation of vapor which can escape through a central passage 206. A supplemental vapor port 210 may also be used located toward the inside of the channel 200 and this port provides an escape route for vapor as the liquid fuel flowing centrifugally outward forces entrained vapor inwardly.

Figure 9:
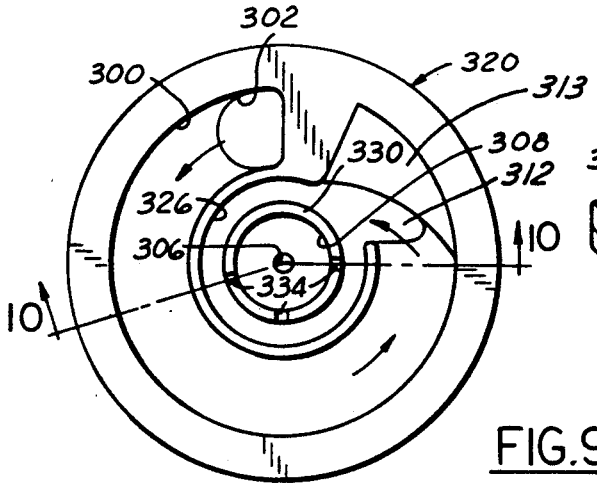
FIG. 9, an elevation of a pump inlet housing showing a second modification as to vapor egress.
Figure 10:
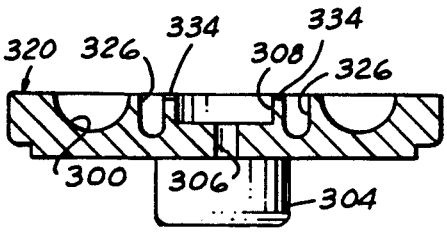
FIG. 10, a section on line 10—10 of FIG. 9.

FIGS. 9 and 10 illustrate a second modification in which the inlet housing 320 has a side channel 300 leading circumferentially to an inner outlet channel 326. Between the outlet channel 326 and the shallow central recess 308 is a centrally located annular wall 330 which has several radial ports 334 on the edge thereof located toward the last half of the passage 326. These ports will bleed off any vapor in the outlet passage 36 where again the centrifugal action moves the solid fuel to the outside of passage 326 and the vapor to the ports on the inside of the passage. A central axial vapor outlet 306 provides egress of the vapor to the outside pump.

Figure 11:
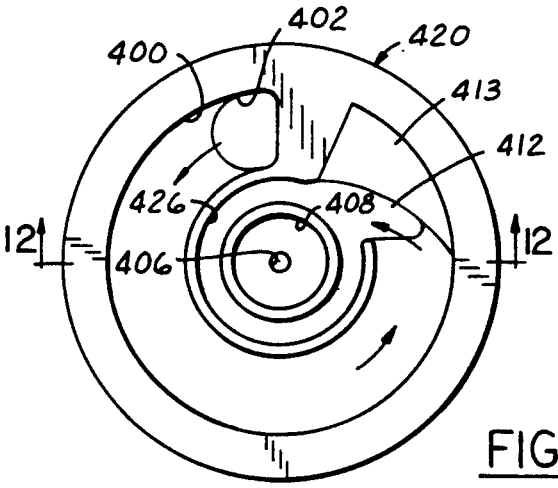
FIG. 11, a third modification of a pump inlet housing.

In FIGS. 11 and 12, an inlet housing 420 has an inlet 402 and a side channel 400 which sweeps around to inwardly direct passage inside rising ramp 413. The vapor outlet 406 is located centrally within chamber 408.

Vapor reaches the central chamber 408 in the same manner as it reaches chamber 108 in FIG. 1.

Figure 13:
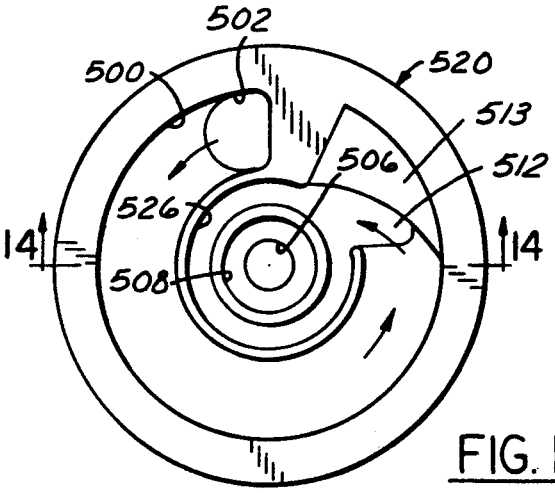
FIG. 13, a fourth modification of the pump inlet housing.
Figure 14:
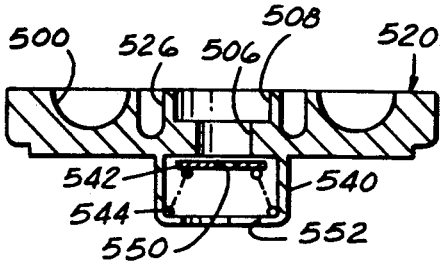
FIG. 14, a section on line 14—14 of FIG. 13.

FIGS. 13 and 14 illustrate yet another modification of the inlet housing 520 for vapor elimination. Vapor reaches the central chamber 508 from the channel pump outlet as illustrated in FIG. 1. A relatively large central port 506 in the wall of the chamber 508 opens to a valve cage 540 in which is located a valve plate 542 biased toward the port opening 506 by a coil spring 544. Plate 542 has a small central opening 550 which is much smaller than port 506. The cage 540 is open at 552. The port 550 is a vapor outlet which may function as described in the previous modifications. However, the spring biased plate may open to vent excess volume of the first stage pump 120 and reduce the load on the pump. If there is no vapor, the valve operates continuously to lower the load on the pump motor and reduce the current draw. If there is a vapor condition, the valve plate will close and vent vapor through hole 550. This use of the valve reduces the axial force of pressure on the channel pump rotor and thus reduces the wear on the rotor significantly. This keeps the ampere draw to a minimum.

What is claimed is:

1. An electrically powered fuel pump assembly for directing fuel under pressure to an internal combustion engine which comprises:

(a) an inlet housing (20) to receive a supply of fuel and having a pumping face with a first annular pumping channel (100) open to a fuel inlet (102) at a first end and open to a fuel outlet (112,126) at a second end, said fuel outlet comprising a second annular channel (126) radially within said first channel, and a central chamber (108) within said second annular channel having a vapor exit port (106), (b) a first spacer housing (24) adjacent said pumping face with outlet passages (122) connecting said central chamber (108) with said second annular channel (126), and having an annular rotor channel (118) facing said first annular pumping channel (100), (c) a first pumping rotor (120) in said rotor channel (118), and (d) means (82) for driving said pumping rotor (120).

2. A fuel pump assembly as defined in claim 1 in which said spacer housing (24) has an annular shroud flange (116) adjacent said pumping rotor having walls to embrace in spaced relation the outer periphery of said rotor (120), said annular flange forming a recess in communication with said fuel outlet passages (122) to cause axial pressure from said outlet to urge said rotor toward said pump face.

3. A fuel pump assembly as defined in claim 2 in which said annular shroud flange (116) overlies the said rotor (120) in closely spaced relation to mechanically limit the axial motion of said rotor away from said pumping face.

4. A fuel pump assembly as defined in claim 1 in which a radial passage between the second end (112) of said pumping channel and said second annular channel includes a radially ramped portion (113) to cause liquid fuel moving outward to force vapor inwardly toward a vapor port.

5. A fuel pump assembly as defined in claim 4 in which an atmospheric vapor outlet port (110) is positioned at the second end (112) of the annular pumping channel (100) at the base of the ramped portion (113).

6. A fuel pump assembly as defined in claim 1 in which a second pump (30) in series with said first pumping rotor is positioned adjacent said spacer housing (24) having pump inlet areas (168) spaced peripherally outwardly of said pumps and outlet passages (122) connecting said central chamber (108) with said second annular chamber (126) are curved outwardly to direct outlet fluid from said first pumping rotor toward the peripheral inlets (168) of said second pump.

7. A fuel pump assembly as defined in claim 1 in which a separating wall (330) between said second annular channel (326) and said central chamber (308) is formed with circumferentially spaced radial passages (334) in communication with said central chamber to admit vapor from said second annular channel to said central chamber (308).

8. A fuel pump assembly as defined in claim 1 in which a valve cage (540) is positioned outside and in communication through a passage (506) with said central chamber (508), a valve member (542) in said cage biased against said passage (506), said valve member having a small perforation (550) to by-pass vapor from said central chamber, said valve being adapted to open against said bias in response to the presence of liquid fuel to by-pass excess liquid output of said first pumping rotor (120).

9. A fuel pump assembly as defined in claim 1 in which a second spacer housing (26) is positioned adjacent said first spacer housing (24), a flat recess (140) is formed in one of said spacer housings to serve as an inlet chamber for a second pump and positioned to receive the output of said first pumping rotor, a second pump housing (30) and rotor (91) adjacent said second spacer housing (26) in series with said first pumping rotor and driven by said driving means (82), and a stationary circular baffle (160) mounted centrally in said flat recess having peripheral flow passages (168) to pass outlet fuel from said first pumping rotor (120) to said second spacer housing (26) through said peripheral flow passages.

10. A pump assembly, as defined in claim 9 in which an axially extending boss (142) is mounted on said second spacer housing (26), said baffle (160) being mounted on said boss and tapering axially away from said boss, an outer flange (164) on said baffle bearing on said second spacer housing, and said peripheral flow passages comprise circumferentially spaced radial openings (168) in said outer flange to admit outlet fuel from said first pumping rotor to the inside of said baffle and to said rotor (92) of said second pump.

11. A pump assembly as defined in claim 10 in which said baffle has a central opening with an inner flange (162), the inner edge (163) of said inner flange (162) having a sharp edge to engage said boss in assembled position.

* * * * *